US008366020B2

(12) United States Patent
Wang et al.

(10) Patent No.: US 8,366,020 B2
(45) Date of Patent: Feb. 5, 2013

(54) SPRINKLER DEVICE

(75) Inventors: Po-Hsiung Wang, Chu-Nan Chen (TW); Tzu-Meng Wang, Chu-Nan Chen (TW)

(73) Assignee: Kwan-Ten Enterprise Co., Ltd., Miao-Li, Hsien (TW)

( * ) Notice: Subject to any disclaimer, the term of this patent is extended or adjusted under 35 U.S.C. 154(b) by 350 days.

(21) Appl. No.: 12/807,954

(22) Filed: Sep. 17, 2010

(65) Prior Publication Data

US 2012/0056014 A1 Mar. 8, 2012

(30) Foreign Application Priority Data

Sep. 3, 2010 (TW) ..... 99217123 U

(51) Int. Cl.
*B05B 3/04* (2006.01)

(52) U.S. Cl. ..... 239/237; 239/200

(58) Field of Classification Search ..... 239/200–207, 239/225.1, 230, 233, 237, 240
See application file for complete search history.

(56) References Cited

U.S. PATENT DOCUMENTS

| | | | | |
|---|---|---|---|---|
| 4,784,325 | A | 11/1988 | Walker et al. | |
| 4,787,558 | A | 11/1988 | Sexton et al. | |
| 6,814,304 | B2 | 11/2004 | Onofrio | |
| 6,883,727 | B2 | 4/2005 | De Los Santos | |
| 7,156,322 | B1 * | 1/2007 | Heitzman | 239/240 |
| 7,168,634 | B2 | 1/2007 | Onofrio | |
| 7,255,291 | B1 * | 8/2007 | Lo et al. | 239/242 |
| 7,988,072 | B2 * | 8/2011 | Miller et al. | 239/242 |

* cited by examiner

*Primary Examiner* — Davis Hwu
(74) *Attorney, Agent, or Firm* — William E. Pelton, Esq.; Cooper & Dunham LLP

(57) ABSTRACT

A sprinkler device has an inlet-driving assembly mounted in by a rotary seat, and an outlet valve whose one end is mounted through the rotary seat and in the inlet-driving assembly and the other end has multiple through holes. A spray nozzle assembly is mounted on the outlet valve and has multiple first and second spray holes communicating with the through holes of the outlet valve and the rotary seat, and has a block flange formed around a periphery thereof. A first and a second O-rings are sequentially mounted on the block flange. One end of the spray nozzle assembly is mounted through a cover mounted on the inlet driving assembly. Subjected to a same pressure from water filled in all parts of the sprinkler device, the first and second O-rings reduce friction between the block flange and the cover to enable a smooth rotation of the spray nozzle assembly.

15 Claims, 17 Drawing Sheets

SPRINKLER DEVICE

BACKGROUND OF THE INVENTION

1. Field of the Invention

The present invention relates to a sprinkler device, and more particularly to a sprinkler device driving flow direction and position of water flowing therein so as to spray different water patterns.

2. Description of the Related Art

A conventional sprinkler device sprays the water inputted therein through water holes of a nozzle of the conventional sprinkler device due to water pressure. With specific structure and design of the water holes of the conventional sprinkler device, water is sprayed out through the water holes of the nozzle in a particular pattern to sprinkle a lawn and decorate with the water pattern formed by the conventional sprinkler device.

With reference to FIGS. 14 to 17, a conventional sprinkler device has a base 80 and a sprinkling assembly. The base 80 has a hollow chamber 801, a hole 802 and a water inlet 803. The hole 802 is formed through a top of the base 80 and communicates with the chamber 801. The water inlet 803 communicates with the chamber 801 for inputting water with a constant water pressure into the chamber 801. The sprinkler assembly has a shaft seat 81, a spin element 82, an outlet valve 83, a rotary seat 84 and a spray nozzle 85.

The shaft seat 81 has a bottom board, at least one water hole 811, a spindle 812 and a mount hole 813. In the present embodiment, the shaft seat 81 has four water slots 811. The four water slots 811 are formed through the shaft seat 81. A bevel wall inside each water slot 811 obliquely intersects with the bottom board so that water with the constant pressure obliquely passes through the water slot 811. The spindle 812 is centrally formed on the bottom board of the shaft seat 81. The mount hole 813 is non-circular and is formed in a top of the spindle 812. The spin element 82 has a shaft hole 821, multiple cutouts, multiple blades 822, two slots 823 and two balls 820. The shaft hole 821 is centrally formed through the spin element 82 and is mounted around the spindle 812. The cutouts are radially formed through the spin element 82 and around an outer wall of the shaft hole 821. The blades 822 are radially and separately formed on a bottom of the spin element 82 and respectively correspond to the water holes 811 of the shaft seat 81. The slots 823 are oppositely formed in a periphery of the spin element 82. The balls 820 are respectively received in the slots 823. The outlet valve 83 has a disk, multiple through holes 832, a shaft column 831 and a center bore 833. The through holes 832 are formed through the disk. The shaft column 831 has a non-circular section and is centrally formed on and downwardly protrudes from a bottom of the outlet valve 83 and corresponds to and is mounted in the mount hole 813 of the shaft seat 81 through the shaft hole 821 of the spin element 82 so that the spin element 82 is positioned on the top of the spin element 82 and is rotated along with the spin element 82. The center bore 833 is centrally formed through the disk and formed in the shaft column 831.

The rotary seat 84 has an annular wall and two protrusions 841. The two protrusions are formed on and protrude from an inside wall of the annular wall. The spray nozzle 85 has a top, a side periphery, a bottom, a block flange 850, multiple first spray holes 851, multiple second spray holes 852, two buckle tongues 853, multiple center water channels 854, multiple side water channels 855 and a shaft 856. The block flange 850 is annularly formed around the side periphery of the spray nozzle 85. The first spray holes 851 are formed through the top of the spray nozzle 85. The second spray holes 852 are formed through the side periphery of the spray nozzle 85. The buckle tongues 853 are oppositely formed on and protrude downwardly from an edge of the block flange 850 and respectively engage the buckles 842. The center water channels 854 are longitudinally formed through the bottom of the of the spray nozzle 85 and respectively communicate with the first spray holes 851. The side water channels 855 are formed through the side periphery of the spray nozzle 85 and respectively communicate with the second spray holes 852. The shaft 856 is mounted on and protrudes downwardly from the bottom of the spray nozzle 85, and is inserted in the center bore 833 of the outlet valve 83 so that the spray nozzle 85 is rotated with the rotary seat 84, the first and second spray holes 851, 852 communicate with the hole 802, the block flange 850 abuts against to block the hole 802, and an edge of the bottom board of the shaft seat 81 is integrated and fixed with an inner wall of the base 80. When the water with high pressure is entered the chamber 801 of the base 80, the water with high pressure flows through the water holes 811 and hits the blades 822 of the spin element 82 to drive the spin element 82 rapidly rotate. Due to a centrifugal force, the balls 820 are moving radially and outwardly to respectively abut against the protrusions 841 so that the rotary seat 84 is pushed to rotate and the spray nozzle 85 is synchronously rotated.

Alternatively, the water with high pressure passes through the spin element 82 and the through holes 832 of the outlet valve 83, selectively goes through the center water channels 854 or the side water channels 855 and are spayed out through the first spray holes 851 and the second spray holes 852. However, the water with high pressure is also filled in the chamber 801 above the shaft seat 81. The water pressure is directly applied to the rotary seat 84 and the spray nozzle 85. Subjected to the water pressure, the block flange 850 abuts against the base 80 and a friction between the block flange 850 and the base 80 results in an issue that the spray nozzle 85 is not rotated smoothly.

SUMMARY OF THE INVENTION

An objective of the present invention is to provide a sprinkler device enabling spray nozzle assembly therein to smoothly rotate with less friction and simultaneously sprinkling.

To achieve the foregoing objective, the A sprinkler device has an inlet and driving assembly, a rotary seat, an outlet valve, a spray nozzle assembly and a cover.

The inlet-driving assembly has a body, a shaft seat and a spin element. The body is hollow and has a top, a bottom, a chamber, an opening and a water inlet. The chamber is defined inside the body. The opening is formed through the top of the body. The water inlet is formed through the bottom of the body. The shaft seat is mounted inside the chamber of the body and has a bottom, a spindle and multiple water holes. The spindle is centrally mounted on and protrudes from the shaft seat. The water holes are formed through the shaft seat. Each water hole is obliquely directed to the bottom of the shaft seat.

The spin element is mounted around the spindle of the shaft seat and has a bottom, a shaft hole, multiple cutouts, two slots, two driving elements and multiple blades. The bottom is adjacent to the shaft seat. The shaft hole is centrally formed through the spin element and mounted around the spindle of the shaft seat. The cutouts are formed through the spin element and around the shaft hole. The slots are oppositely formed through the spin element. Each driving element is received in a corresponding slot. The blades are formed on the bottom of the spin element and respectively driven to rotate by water entered through the water holes of the shaft seat.

The rotary seat is an annular body in cross section, is mounted outside the spin element, is mounted around the spindle of the shaft seat and has a top, an inner wall, two push blocks and multiple through holes. The push blocks are formed on and protrude from the inner wall of the rotary seat, respectively correspond to and are selectively driven by the driving elements to move when respectively abutting against the driving elements. The through holes are formed through the top of the rotary seat.

The outlet valve is connected to the shaft seat and has a disk, a shaft column, a shaft hole and multiple through holes. The disk has a top and a bottom. The shaft column is formed on and protrudes downwardly from the bottom of the disk and is mounted through the spindle of the shaft seat. The shaft hole is centrally formed in the top of the disk. The through holes are circumferentially formed through the disk.

The spray nozzle assembly is hollow, is connected to the outlet valve and has a first end, a second end, a periphery, multiple first spray holes, multiple second spray holes, multiple alignment holes, multiple cutouts, a shaft rod and a block flange. The first spray holes are formed through the first end. The second spray holes are formed through the first end. The alignment holes are formed through the second end, respectively communicate with the first spray holes and selectively align with the through holes of outlet valve. The cutouts are formed through the second end and respectively communicate with the second spray holes. The shaft rod is formed on and protrudes from the second end. The block flange is formed on and protrudes from the periphery of the spray nozzle assembly.

The cover is mounted on the spray nozzle assembly and has an inner space, a center hole, a first O-ring and the second O-ring. The center hole is centrally formed through the cover, wherein the first end of the spray nozzle assembly protrudes beyond the center hole of the cover. The first O-ring is mounted on the block flange of the spray nozzle assembly. The second O-ring is mounted on the first O-ring. The cover is mounted at the opening of the body, and the inner space of the cover and the shaft seat, the spin element, the rotary seat and outlet valve communicate with each other so that water entered from the water inlet is filled with the inner space of the cover.

The sprinkler device of the present invention is featured by a constant pressure of water filled inside the spindle, the spin element, the rotary seat and the spray nozzle assembly when water enters the space between the body of the inlet driving assembly and the cover, and the first O-ring and the second O-ring. The water with constant pressure of water is not acted on a bottom edge of the spray nozzle element alone. The rotary seat and the spray nozzle assembly can be simultaneously rotated when water enters the inlet-driving assembly to spin the spin element. The first O-ring and the second O-ring mounted between the spray nozzle assembly and the cover further reduce friction generated when the spray nozzle assembly is rotated. The aforementioned features address a solution to smoothly rotate the spray nozzle assembly without easily wearing out the spray nozzle assembly.

Other objectives, advantages and novel features of the invention will become more apparent from the following detailed description when taken in conjunction with the accompanying drawings.

DETAILED DESCRIPTION OF THE INVENTION

Figure 1:
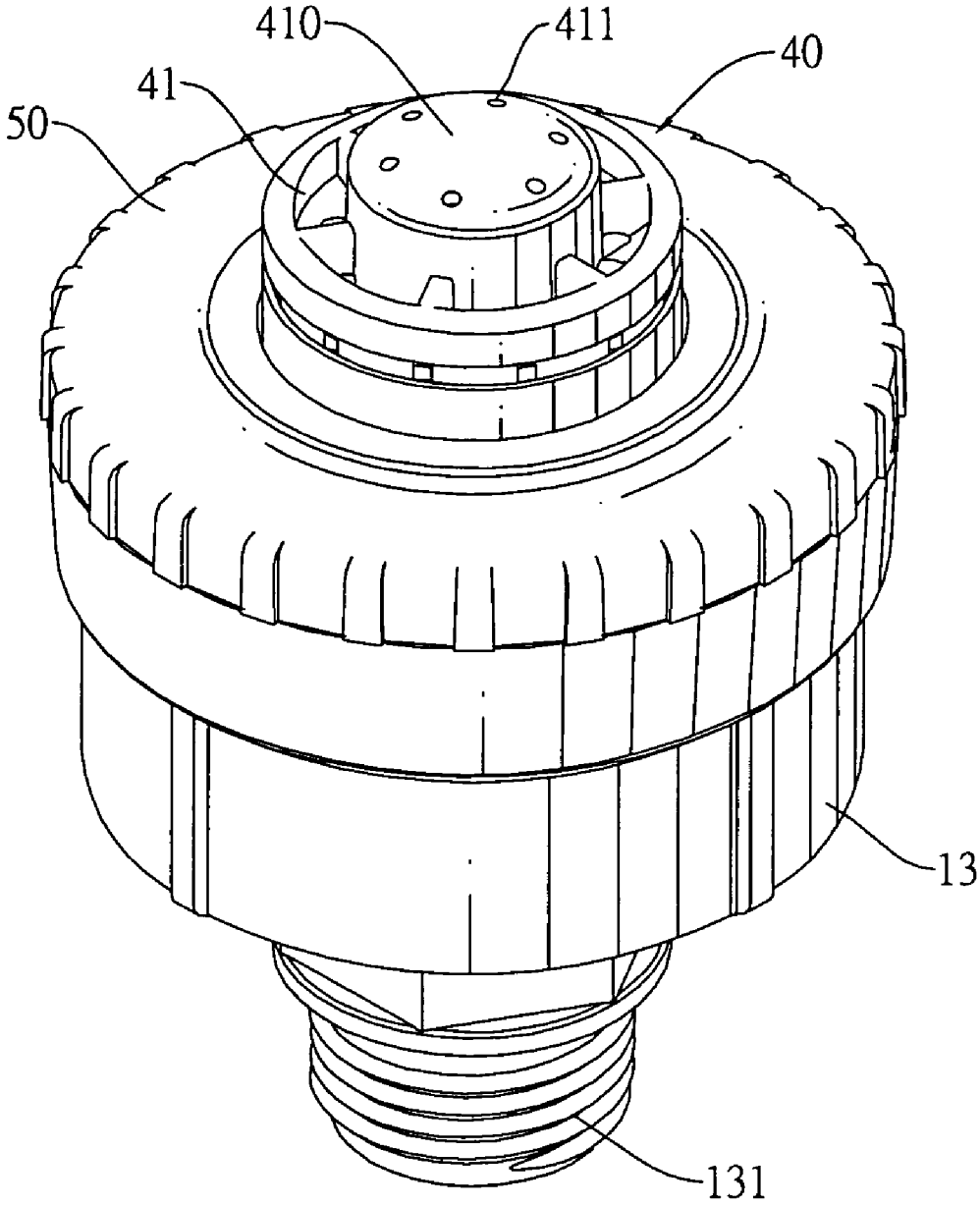
FIG. 1 is a perspective view of a first embodiment of a sprinkler device in accordance with the present invention.
Figure 2:
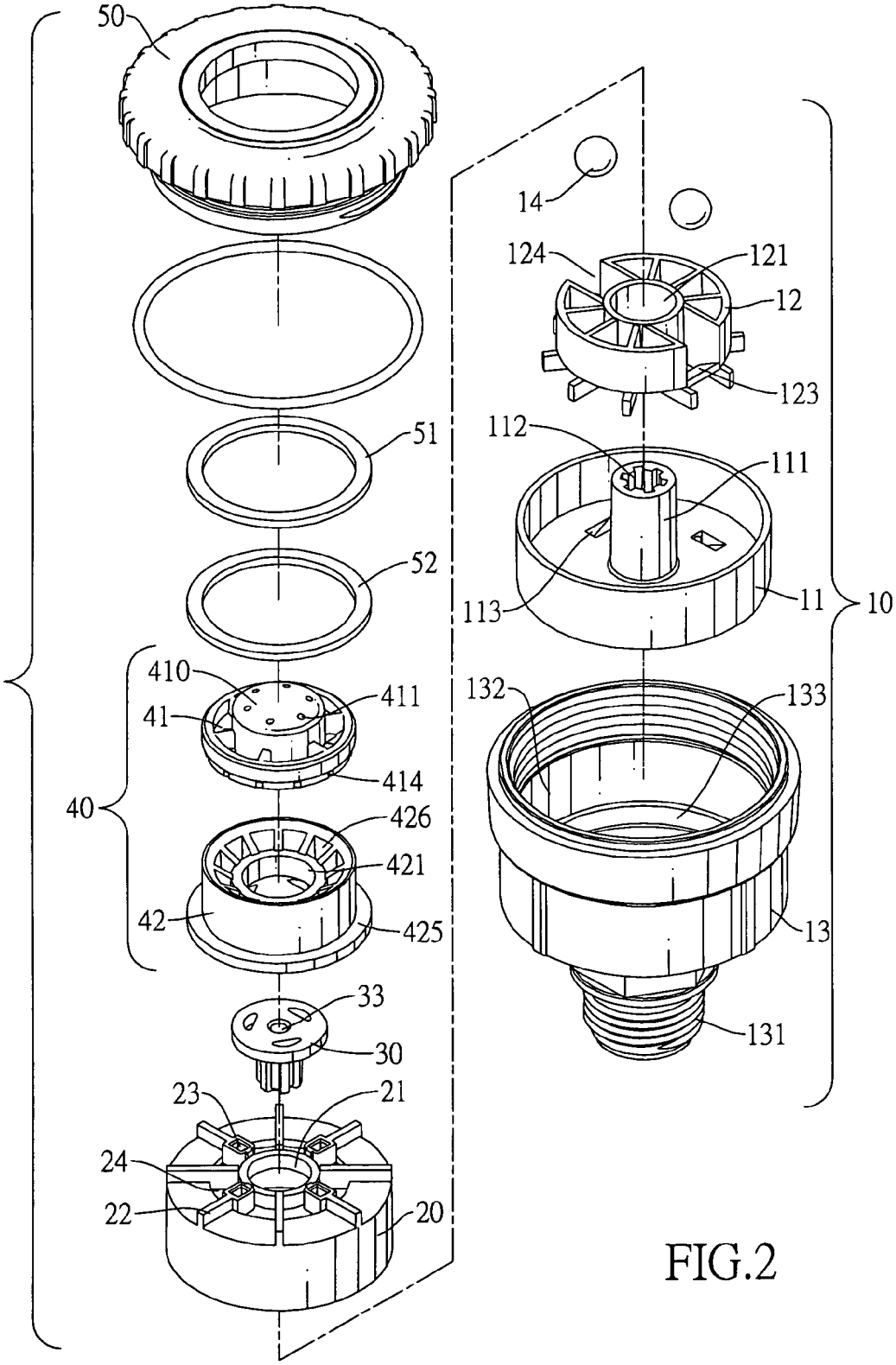
FIG. 2 is an exploded perspective view of the sprinkler device in FIG. 1.

With reference to FIGS. 1 and 2, a first embodiment of a sprinkler device in accordance with the present invention has an inlet-driving assembly 10, a rotary seat 20, an outlet valve 30, a spray nozzle assembly 40 and a cover 50.

Figure 3:
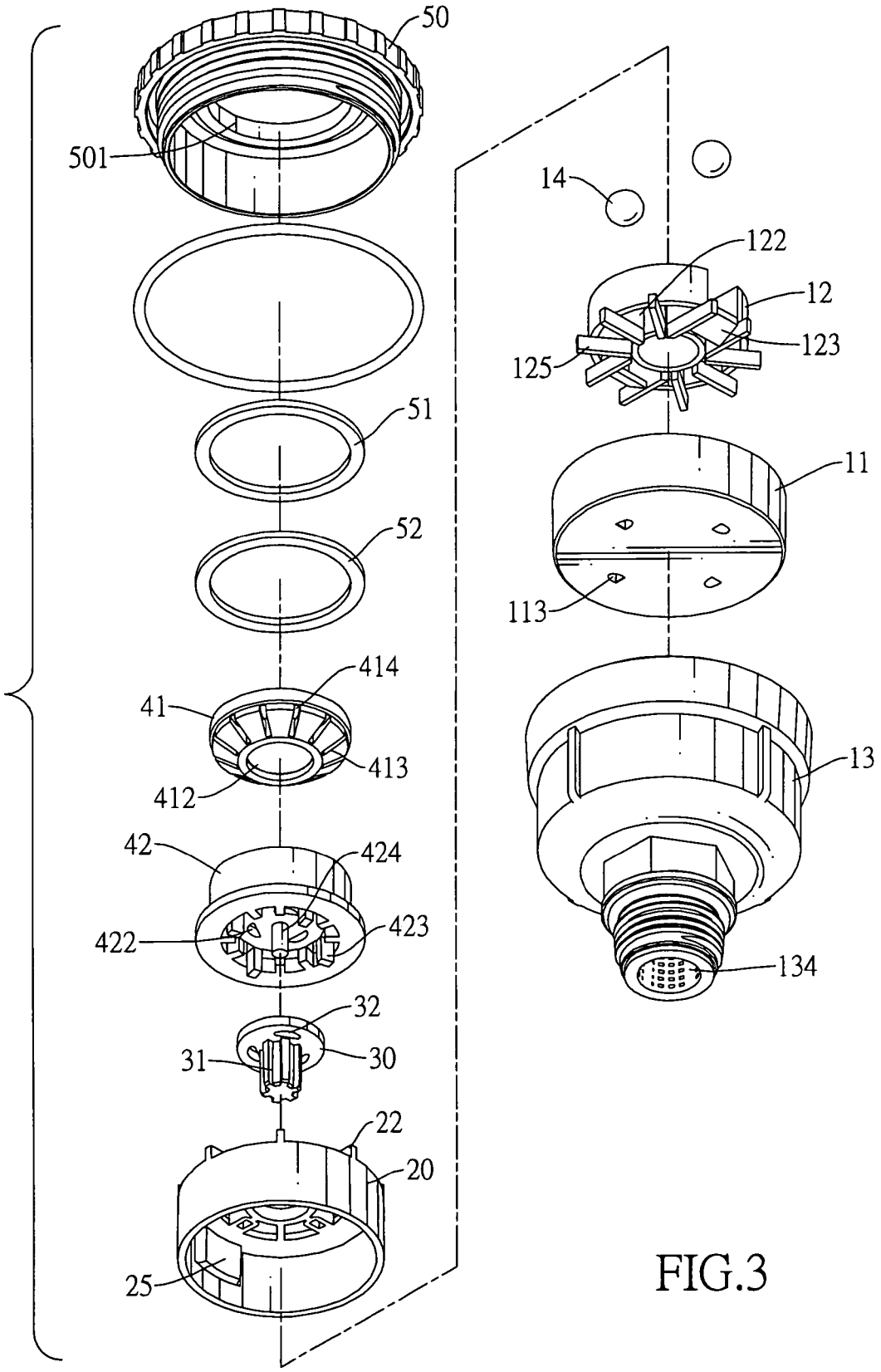
FIG. 3 is another exploded perspective view of the sprinkler device in FIG. 1.

With further reference of FIG. 3, the inlet-driving assembly 10 has a body 13, a shaft seat 11, a spin element 12 and a driving element 14. The body 13 is hollow and has a chamber 132, an opening, inner threads, a stepwise portion 133 and a mounting end 131. The chamber 132 is defined in the body 13. The opening is formed through a top of the body 13 and communicates with the chamber 132. The inner threads are formed on an inner wall of the body 13 and extend downwardly from the opening. The stepwise portion 133 is formed on the inner wall of the body 13 and beneath the inner threads. The mounting end 131 is formed on a bottom of the body 13 and has a water inlet 134 communicating with the chamber 132. The mounting end 131 has threads formed on a periphery of the mounting end 131.

Figure 4:
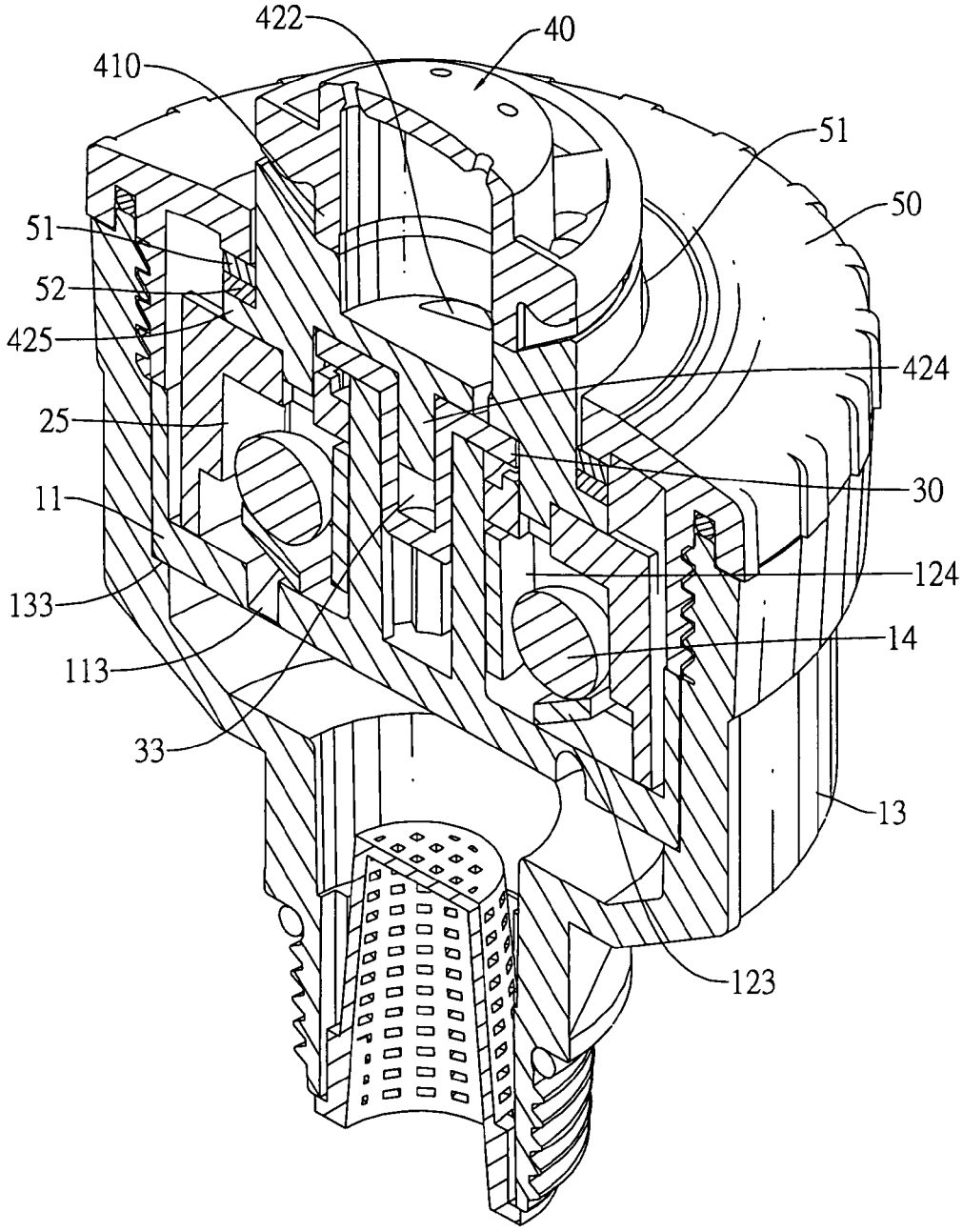
FIG. 4 is a perspective view in partial section of the sprinkler device in FIG. 1.
Figure 5:
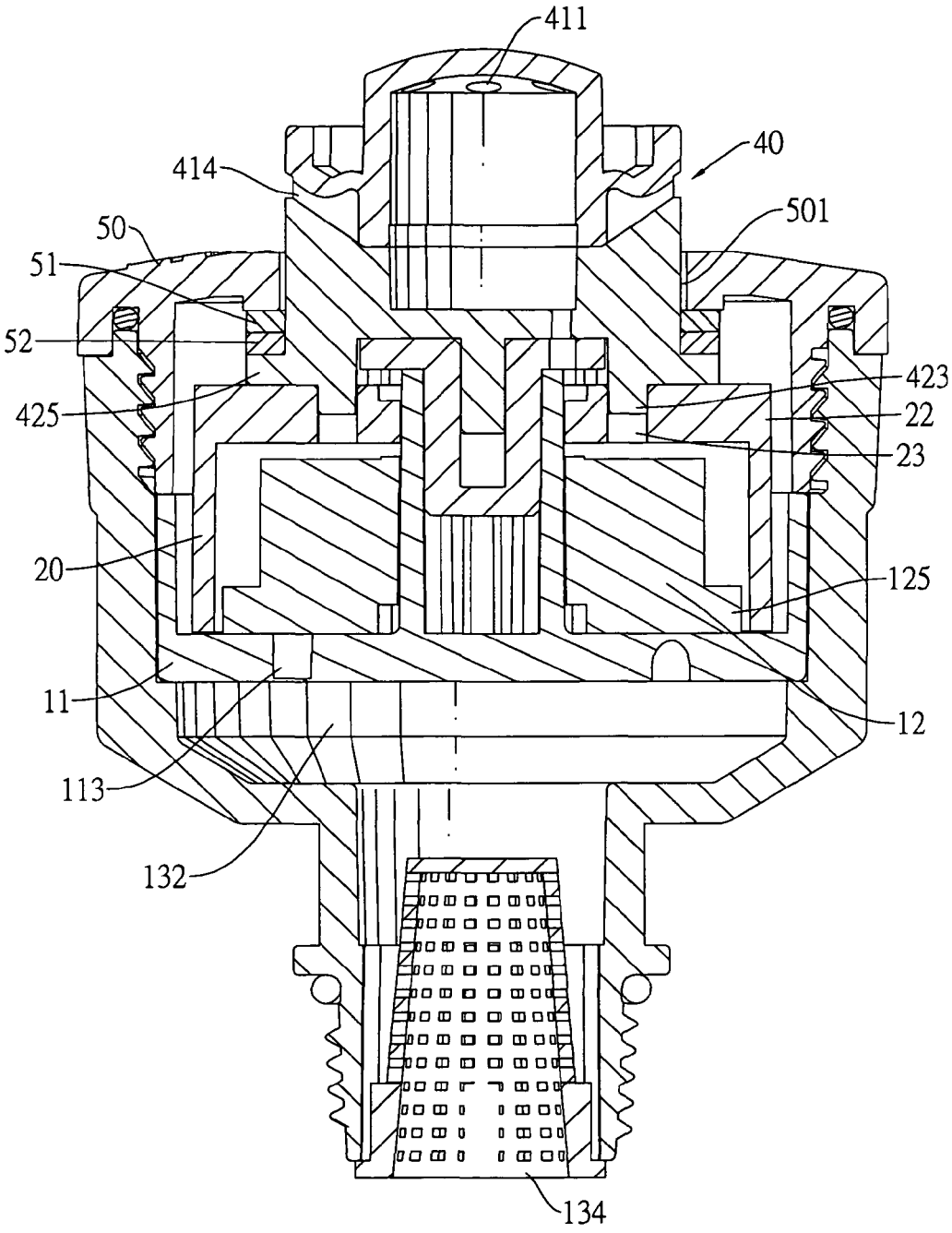
FIG. 5 is a cross-sectional side view of the sprinkler device in FIG. 1.

The shaft seat 11 is an annular wall in cross section and has a bottom board, a sidewall, a spindle 111, a positioning hole and multiple water holes 113. The sidewall is formed around a perimeter of the bottom board. The spindle 111 is centrally formed on and protrudes upwardly from the bottom board. The positioning hole 112 is formed on and recessed from a top of the spindle 111 and has a non-circular section. The water holes 113 are formed through the bottom board. Two inner walls of each water hole 113 obliquely intersect with the bottom board. With further reference to FIGS. 4 and 5, a bottom of the shaft seat 11 is mounted on the stepwise portion 133 of the body 13.

The spin element 12 is an annular body in cross section, has a board and multiple annular walls formed around a perimeter of the board, and has a shaft hole 121, multiple cutouts 122, two slots 124, two guide piece 123, two driving elements 14 and multiple blades 125. The shaft hole 121 is centrally and longitudinally formed through the board of the spin element 12 and is mounted around the spindle 111 of the shaft seat 11. The cutouts 122 are circumferentially formed through the spin element and around the shaft hole 121. The slots 124 are oppositely formed through the board of the spin element 12. Each guide piece 123 is formed inside a corresponding slot 124 and extends obliquely and upwardly from the board of the spin element 12. Each driving element 14 is a metal ball and is received in a corresponding slot 124 and on a corresponding guide piece 123. The blades 125 are radially and separately formed on a bottom of the spin element 12 and respectively correspond to the water holes 113 of the shaft seat 11.

The rotary seat 20 is hollow, has a top board and an annular wall formed around a perimeter of the top board, has an outer diameter smaller than an inner diameter of the shaft seat 11, and has multiple top bars 22, a shaft hole 21, multiple locating holes 23, multiple through holes 24 and two push blocks 25. The top bars 22 are radially formed on and protrude upwardly from the top board. The shaft hole 21 is centrally formed through the top board. Each locating hole 23 is formed through a corresponding top bar 22 and is adjacent to the shaft hole 21. The through holes 24 are formed through the top board of the rotary seat 20 and each through hole 24 is formed between two adjacent top bars 22. The push blocks 25 are oppositely formed on and protrude from an inner wall of the annular wall of the rotary seat 20. Because the shaft hole 21 of the rotary seat 20 is mounted around the spindle 111 of the shaft seat 11 and the spin element 12 is received in the rotary seat 12, the push blocks 25 respectively correspond to the slots 124 and the driving elements 14 of the spin elements 12. When each driving elements 14 centrifugally and outwardly abuts a corresponding push block 25, the rotary seat 20 is selectively rotated synchronously with the spin element 12 when the driving elements 14 respectively abut against the push blocks 25 or stays still when the driving elements and the push blocks 25 are separated.

The outlet valve 30 has a disk and a shaft column 31, a shaft hole 33 and multiple through holes 32. The shaft column 31 is formed on and protrudes downwardly from a bottom of the disk and has a non-circular section. The shaft hole 33 is centrally formed in the disk. The through holes 32 are circumferentially formed through the disk. The shaft column 31 of the outlet valve 30 is mounted through the shaft hole 21 of the shaft seat 20 and the shaft hole 121 of the spin element 12 and is mounted in the positioning hole 112 so that the rotary seat 20 and the spin element 12 are synchronously rotated when subjected to a water pressure.

The spray nozzle assembly 40 has a top nozzle 41 and a bottom nozzle 42 connected to each other. The top nozzle 41 is hollow and has a bottom, a center post 410, multiple first spray holes 411, a bottom hole 412, multiple narrow channels 413, multiple water channels and multiple second spray holes 414. The bottom of the top nozzle 41 is cone-shaped. The center post 410 is centrally formed inside the top nozzle 41. The first spray holes 411 are formed through a top of the center post 410. The bottom hole 412 is formed in a bottom of the center post 410 and communicates with the first spray holes 411. The narrow channels 413 are radially and separately formed in the bottom of the top nozzle 41. Each narrow channel 413 has a top portion and a bottom portion. The top nozzle 41 engages the bottom nozzle 42 at the top portions and a second spray hole 414 is formed in the top portion of a corresponding top nozzle 41. Each water channel is formed around a periphery of the cone-shaped bottom and between two narrow channels 413. Each second spray hole 414 is located at the top portion of a corresponding narrow channel 413.

The bottom nozzle 42 is hollow and has a top surface, a bottom surface, a top hole 421, a shaft rod 424, multiple cutouts 426, multiple positioning ribs 423, multiple alignment holes 422 and a block flange 425. The top surface is a conical surface recessed inwardly. The top surface corresponds to the bottom of the top nozzle 41. The top hole 421 is centrally formed in the top surface of the bottom nozzle 42 and communicates with the bottom hole 412 of the top nozzle 41. The shaft rod 424 is centrally formed on and protrudes downwardly from the bottom surface, and is pivotally mounted in the shaft hole 33 of the outlet valve 30. The cutouts 426 are separately formed through a circumferential portion of the bottom surface of the bottom nozzle 42 around the shaft rod 424 and each cutout 426 corresponds to the bottom portion of a corresponding narrow channel 413. The positioning ribs 423 respectively correspond to the locating holes 23 of the rotary seat 20. Each positioning rib 423 is formed between two corresponding cutouts 426 and around the shaft rod 424 and is inserted in a corresponding locating hole 23 of the rotary seat 20. The alignment holes 422 are formed through the bottom surface of the bottom nozzle 42. Each alignment hole 422 communicates with the bottom hole 412 of the top nozzle 41 and selectively aligns with a corresponding through hole 32 to communicate with or block the through hole 32 by a relative movement between the bottom surface of the bottom nozzle 42 and a top of the outlet valve 30. The block flange 425 is formed on and protrudes outwardly from a periphery of the bottom nozzle 42.

The cover 50 has threads, a center hole 501, a first O-ring 52 and a second O-ring 51. The threads are formed on a periphery of the cover 50. The center hole 510 is centrally formed through the cover 50 and has an inner diameter smaller than an outer diameter of the block flange 425. The first O-ring 52 and the second O-ring 51 are sequentially mounted around the spray nozzle assembly 40 and are placed on the block flange 425. The first O-ring 52 and the second O-ring may be made of polytetrafluoroethylene (PTFE), i.e. a wear-resistant material, and a waterproof material respectively. The threads of the cover 50 are screwed into the inner threads of the body 13 An inner side of the cover 50 abuts against the first O-ring 52 and the second O-ring 51.

Figure 6:
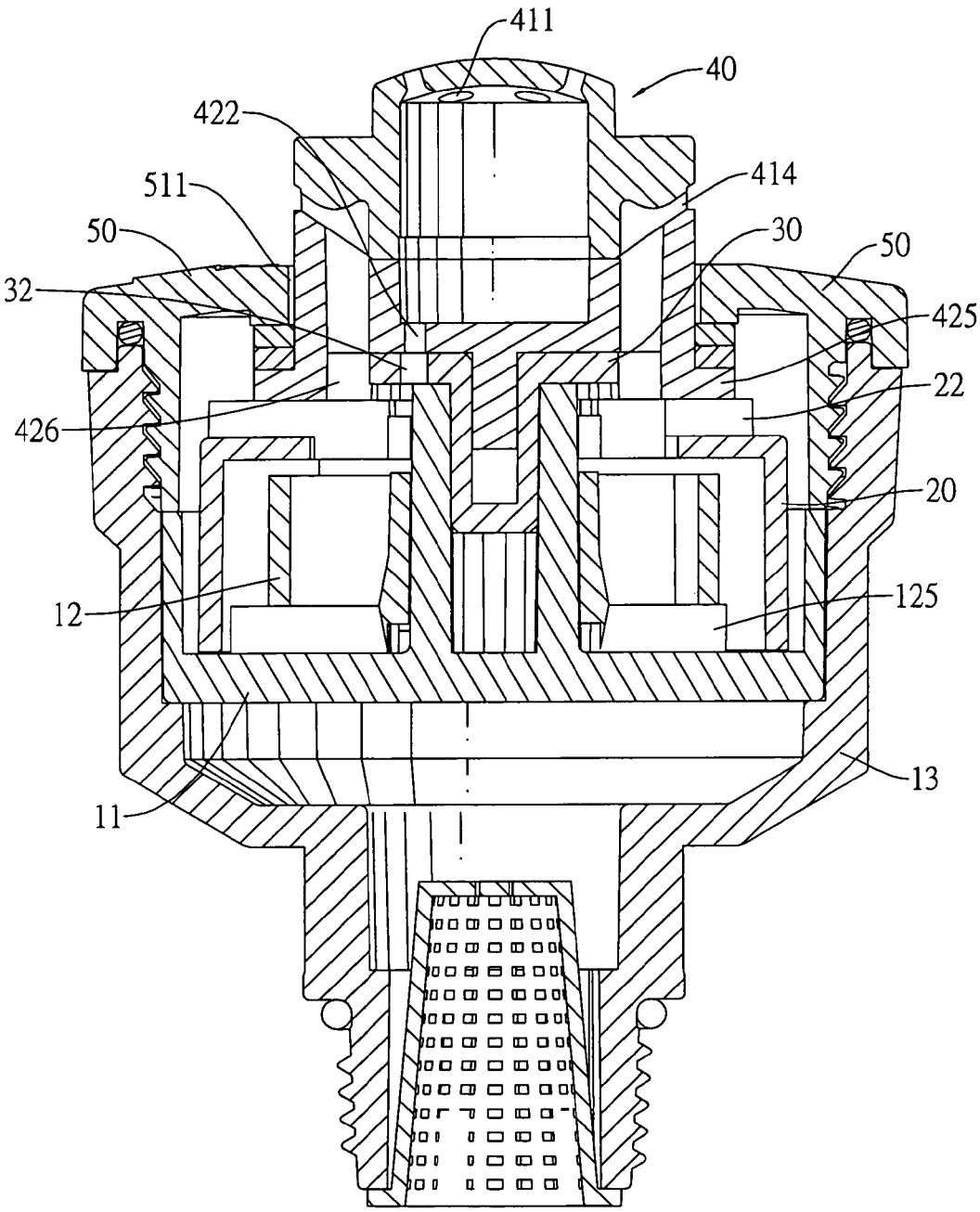
FIG. 6 is another cross-sectional side view of the sprinkler device in FIG. 1.

With reference to FIGS. 4 to 6, when the sprinkler device as described is operated, pressurized water enters the chamber 132 through the water inlet 134 of the body 13. Water further passes each water hole 113 of the shaft seat 11 and propels each blade 125 of the spin element 12 to rapidly spin the spin element 12. A centrifugal force as a result of the rapid rotation of the spin element 12 moves the driving element 14 in a corresponding slot 124 obliquely and upwardly along the guide piece 123 to abut against an inner wall of the rotary seat 20. Meanwhile, water is also filled with the chamber 132 between the body 13 and the cover 50 and the corresponding places of the shaft seat 11, the spin element 12, the rotary seat 20 and the outlet valve 30 maintain a consistent pressure everywhere inside the sprinkler device. As water pressure is not concentrated on the spray nozzle assembly 40, the spray nozzle assembly 40 is smoothly rotated when being driven to rotate.

When each driving element 14 abuts against a corresponding push block 25 on the inner wall of the rotary seat 20, the rotary seat 20 is rotated along with the spin element 12. Since the positioning ribs 423 of the spray nozzle assembly 40 respectively engage the locating holes 23 of the rotary seat 20, the spray nozzle assembly 40 is also rotated. After the alignment holes 422 of the rotated bottom nozzle 42 respectively align with the through holes 32 of the outlet valve 30, the pressurized water is sprayed out through the first spray holes 411. Additionally, the pressurized water is also sprayed out through the cutouts 122 of the spin element 12, the through holes 24 of the rotary seat 20 and the cutouts 426 of the bottom nozzle 42. With the design of the sprinkler device as described, different spray patterns of water can be generated to achieve the purpose of both sprinkling and providing multiple spray patterns.

Figure 7:
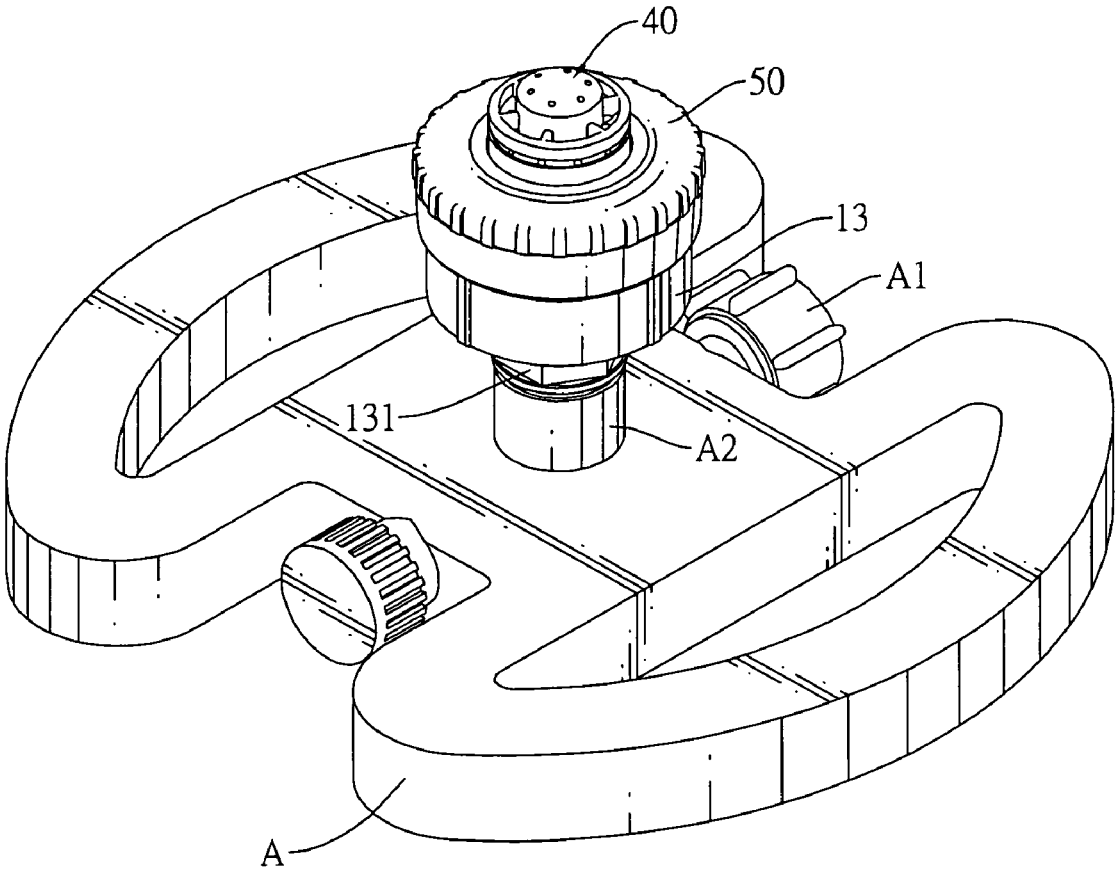
FIG. 7 is an operational perspective view of the sprinkler device in FIG. 1 mounted on a flat mounting seat.
Figure 8:
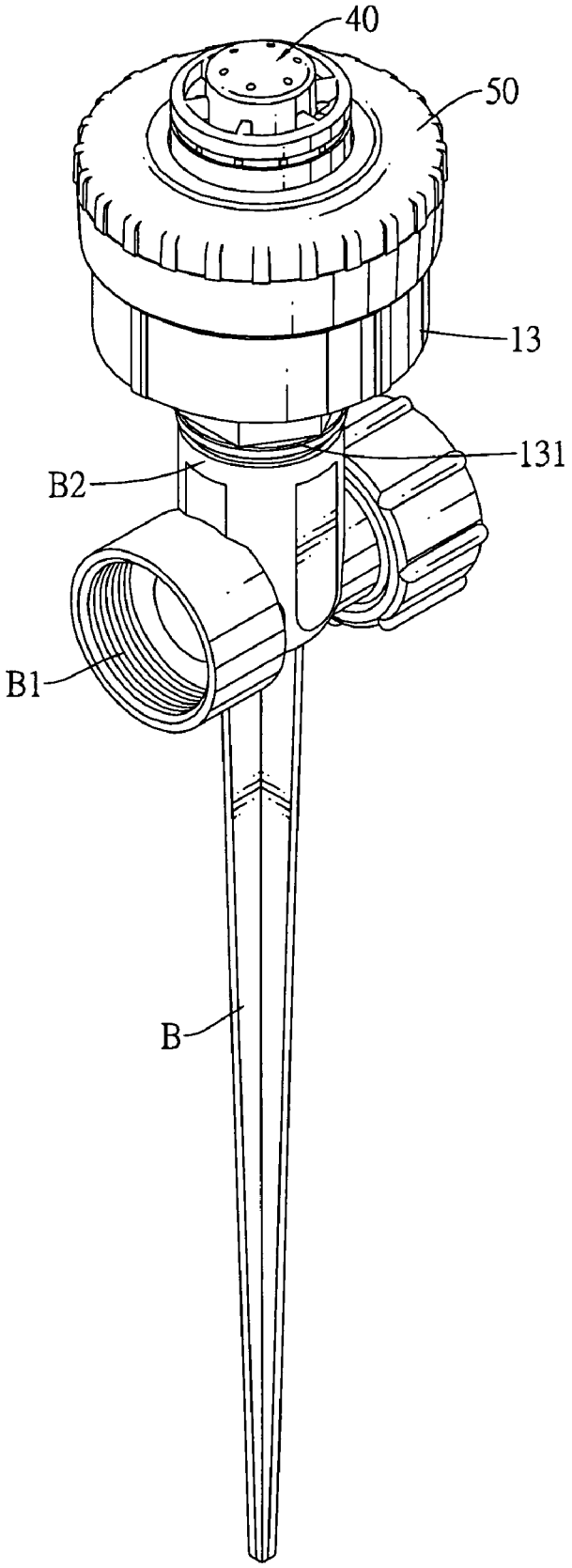
FIG. 8 is an operational perspective view of the sprinkler device in FIG. 1 mounted on a narrow mounting seat.

With reference to FIG. 7, the sprinkler device as described is mounted on a flat mounting seat A. The mounting seat A has a bottom surface with a large area. The bottom surface of the mounting seat A is placed on an operating location, such as on a lawn. The mounting seat A has a holder A2 and a water inlet A1. The holder A2 is hollow and is centrally mounted on the mounting seat A. The water inlet A1 is mounted on a side of the mounting seat A for water to flow in, and communicates with the holder A2. The mounting end 131 of the body 13 of the first embodiment engages the holder A2. The engagement means may be mutually screwed with threads. With reference to FIG. 8, the sprinkler device as described may be collaborated with a narrow mounting bar B so that the present embodiment can be inserted in a mounting place to operate, such as a lawn. The mounting bar B has a holder B2 and a water inlet B1. The holder B2 is mounted on a top of the mounting bar B and engages the mounting end 131 of the body 13 of the sprinkler device. The engagement means may be mutually screwed with threads. The water inlet B1 is also mounted on the top of the mounting seat B for water to flow in, and communicates with the holder B2.

Figure 9:
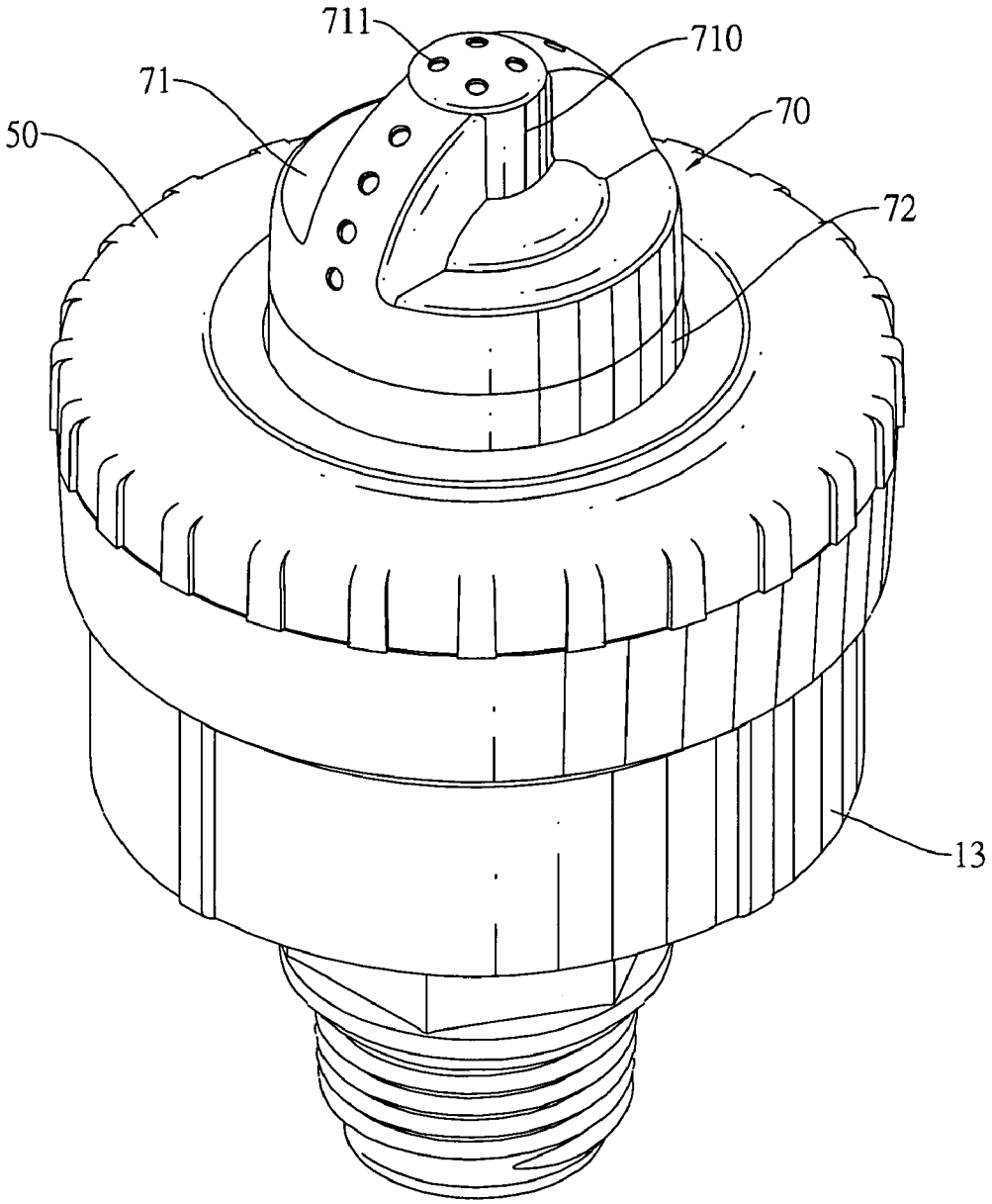
FIG. 9 is a perspective view of a second embodiment of a sprinkler device in accordance with the present invention.
Figure 10:
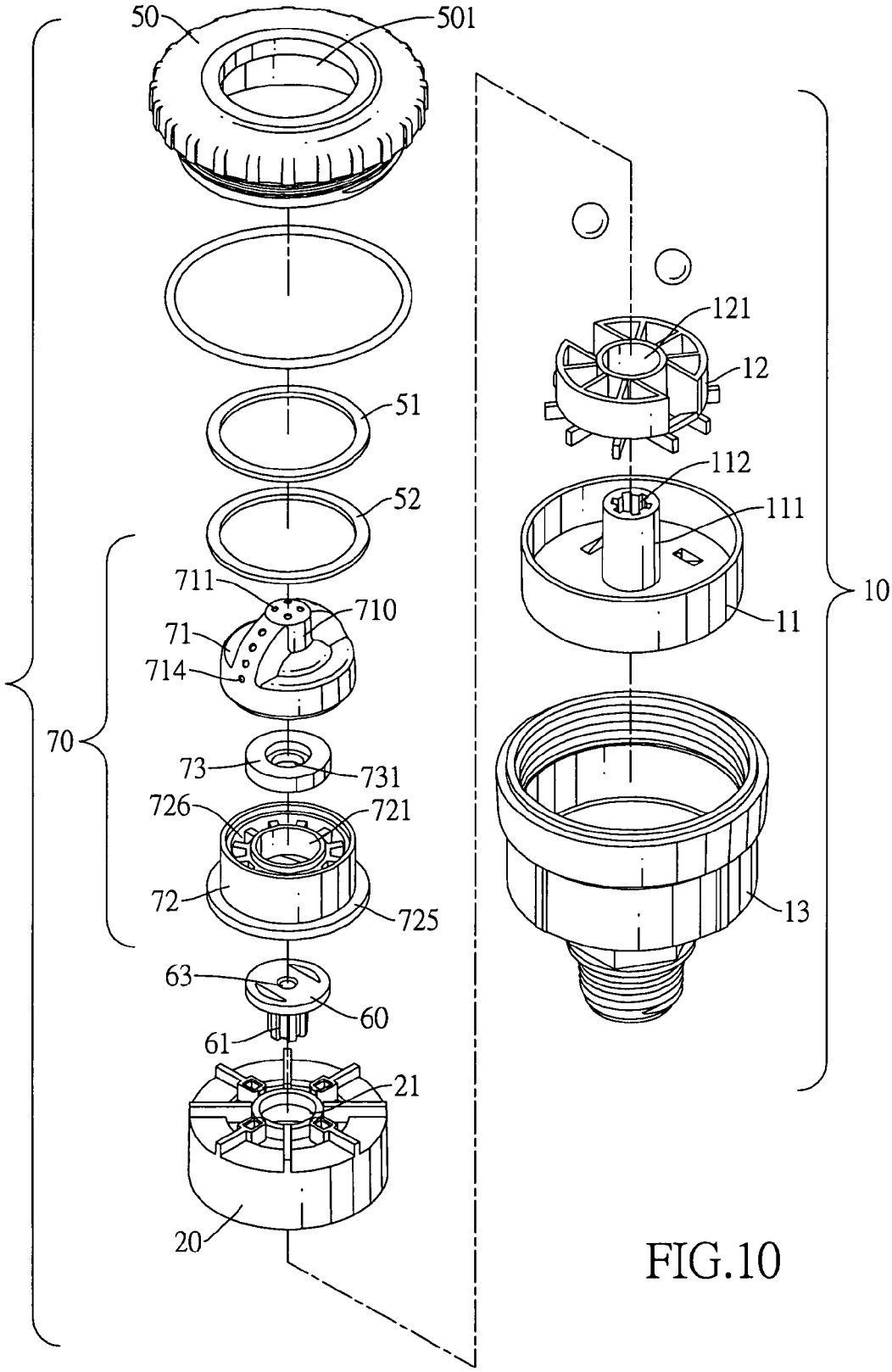
FIG. 10 is an exploded perspective view of the sprinkler device in FIG. 9.
Figure 11:
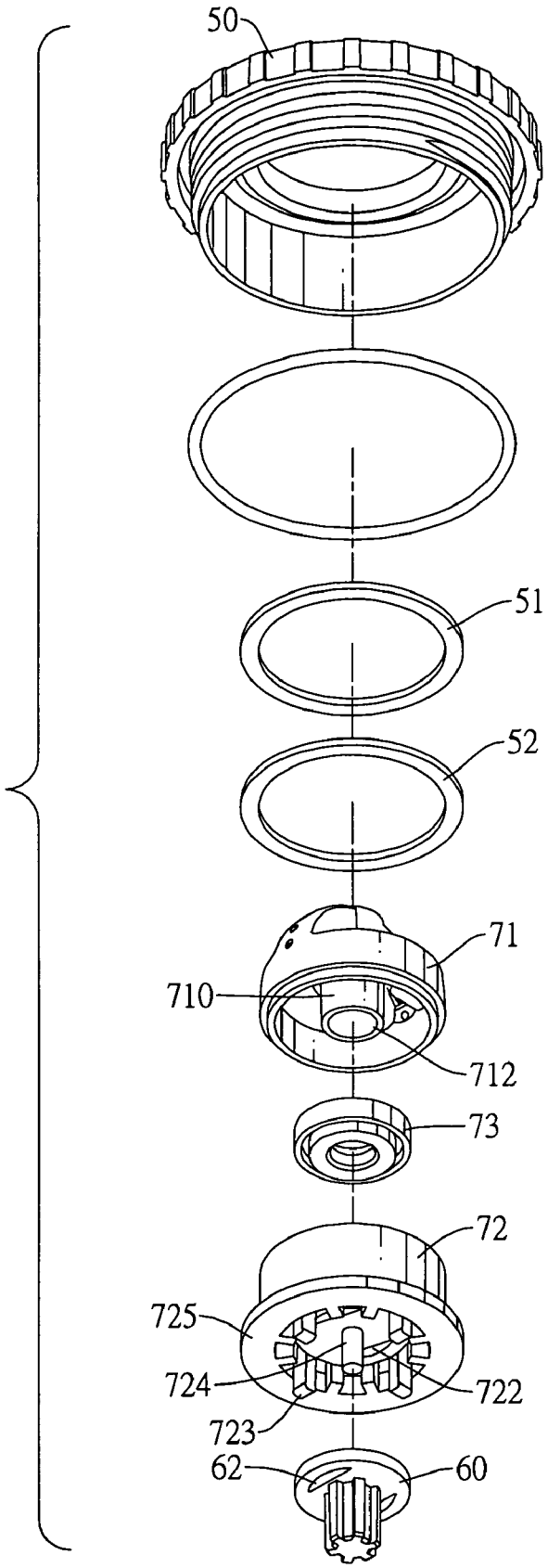
FIG. 11 is a partial exploded perspective view of the sprinkler device in FIG. 9.

With reference to FIGS. 9 to 11, a second embodiment of a sprinkler device in accordance with the present invention has an inlet-driving assembly 10, a rotary seat 20, an outlet valve 30, a spray nozzle assembly 70 and a cover 50.

With reference to FIGS. 10 and 11, the inlet-driving assembly 10 further has a body 13, a shaft seat 11, a spin element 12 and a driving element. The rotary seat 20 is mounted inside the body 13 and outside the shaft seat 11. The connection of the inlet-driving assembly 10 and the rotary seat 20 is the same as that of the first embodiment and is not repeated here.

The outlet valve 60 has a disk and a shaft column 31, and has a shaft hole 63 and multiple through holes 62. The shaft column 31 is formed on and protrudes downwardly from a bottom of the disk and has a non-circular section. The through holes 32 are circumferentially formed through the disk. When the shaft column 61 penetrates through the shaft hole 21 of the shaft seat 20 and the shaft hole 121 of the spin element 12, the shaft column 61 of the outlet valve 60 engages the positioning hole 112 of the shaft seat 11 so that the rotary seat 20 and the spin element 12 are synchronously rotated when subjected to a water pressure.

Figure 12:
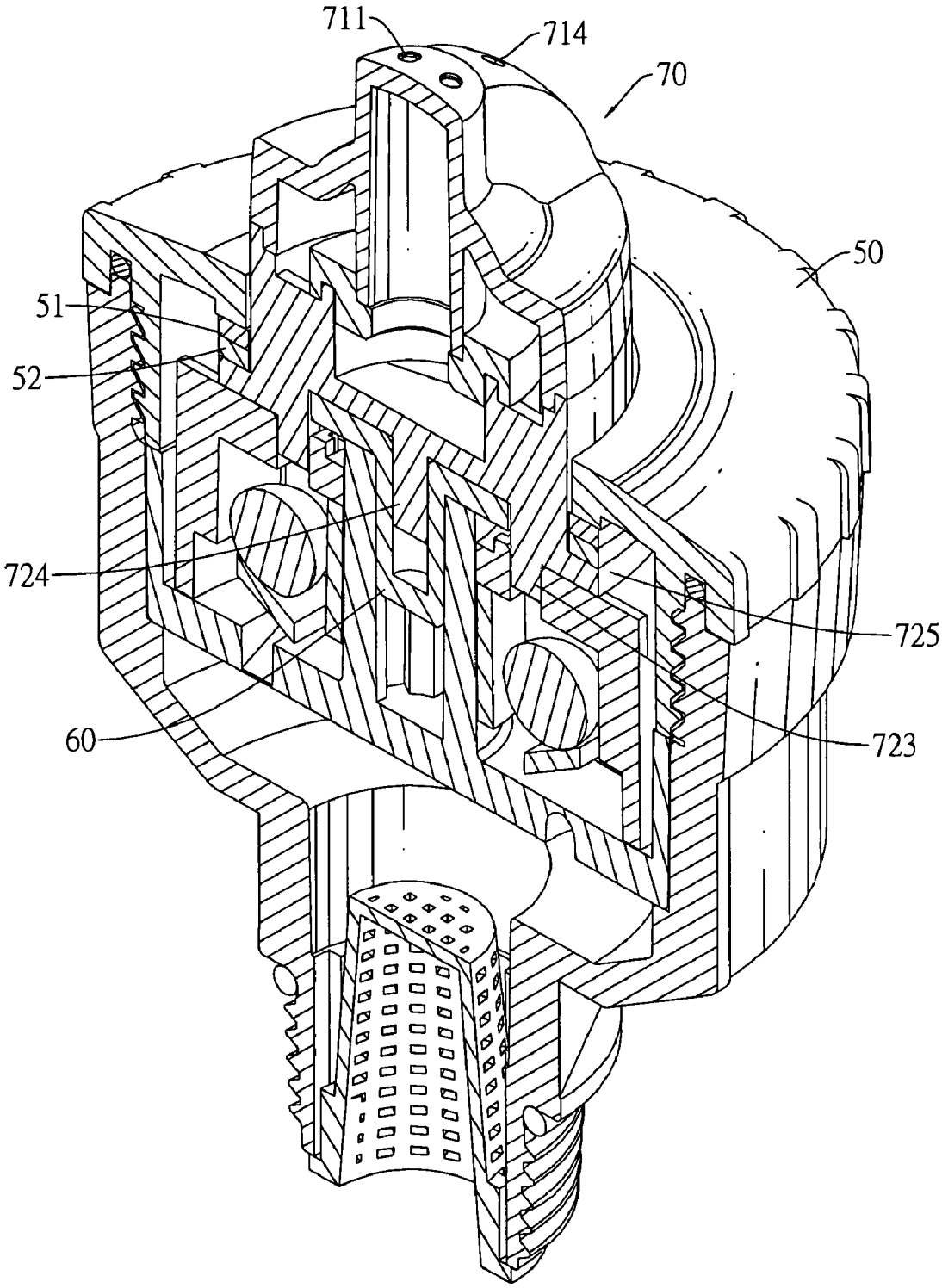
FIG. 12 is a perspective view in partial section of the sprinkler device in FIG. 9.
Figure 13:
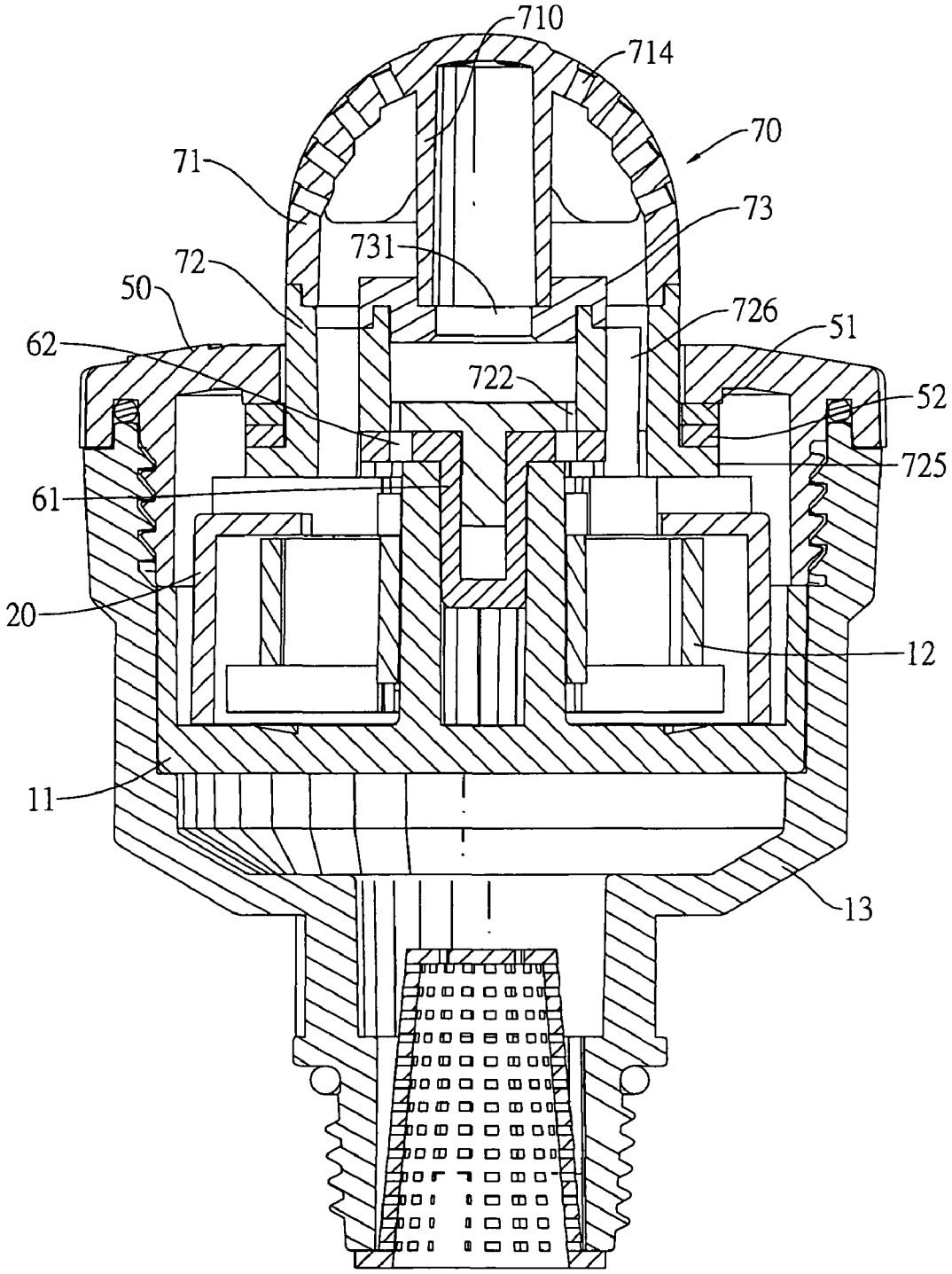
FIG. 13 is a cross-sectional side view of the sprinkler device in FIG. 9.
Figure 14:
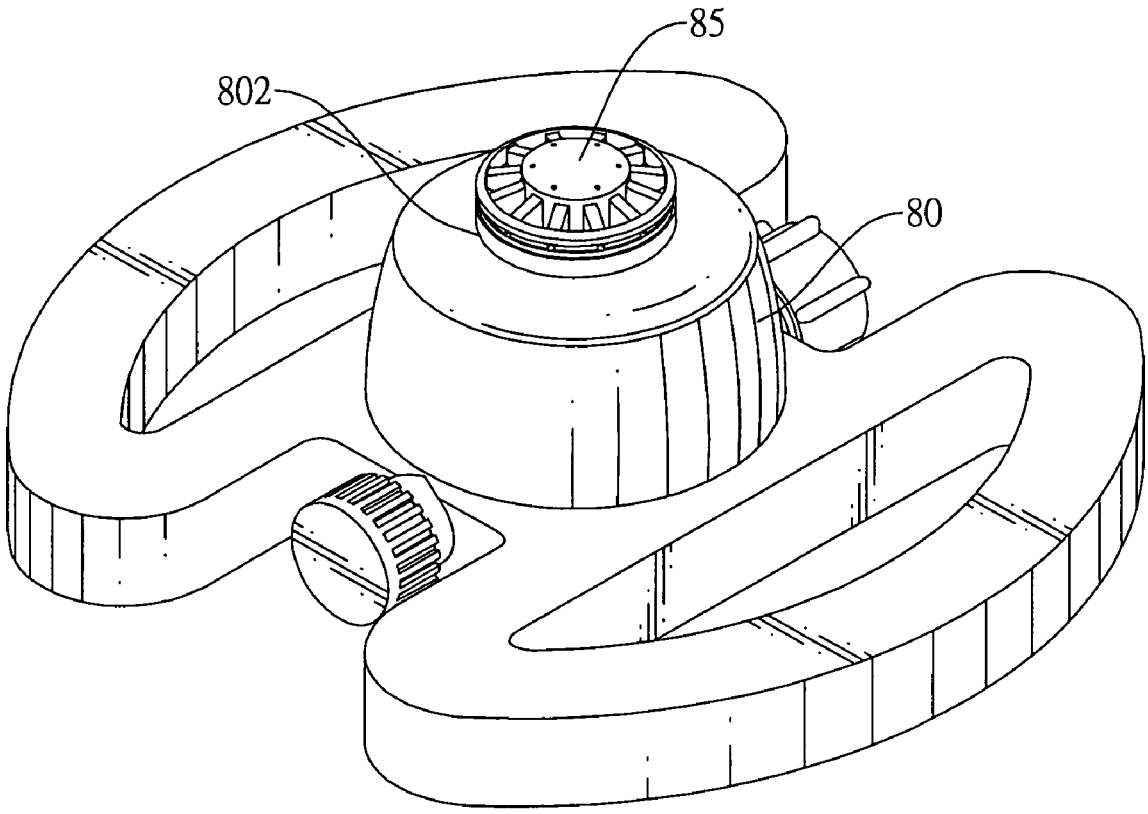
FIG.14 PRIOR ART
FIG. 14 is an operational perspective view of a conventional sprinkler device in accordance with the present invention mounted on a mounting seat.
Figure 15:
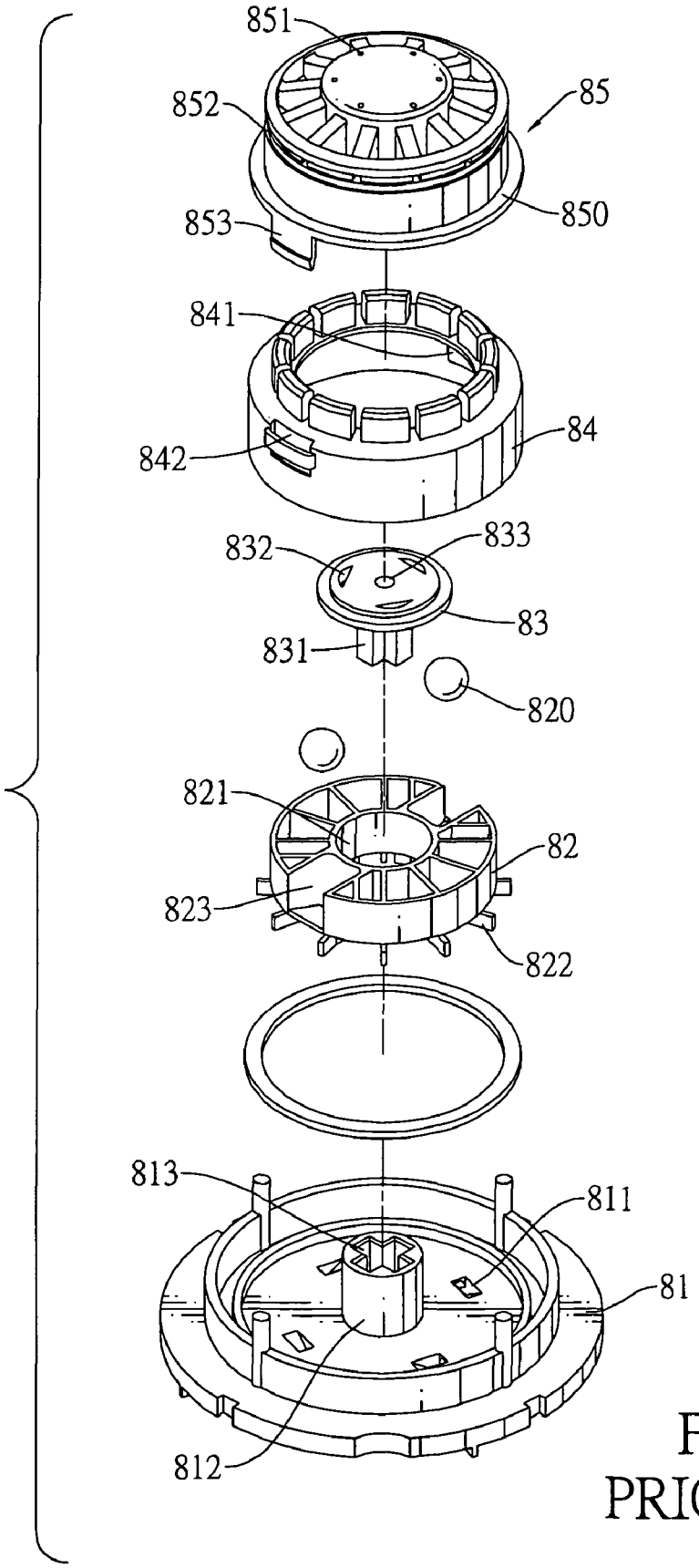
FIG.15 PRIOR ART
FIG. 15 is an exploded perspective view of the conventional sprinkler device in FIG. 14.
Figure 16:
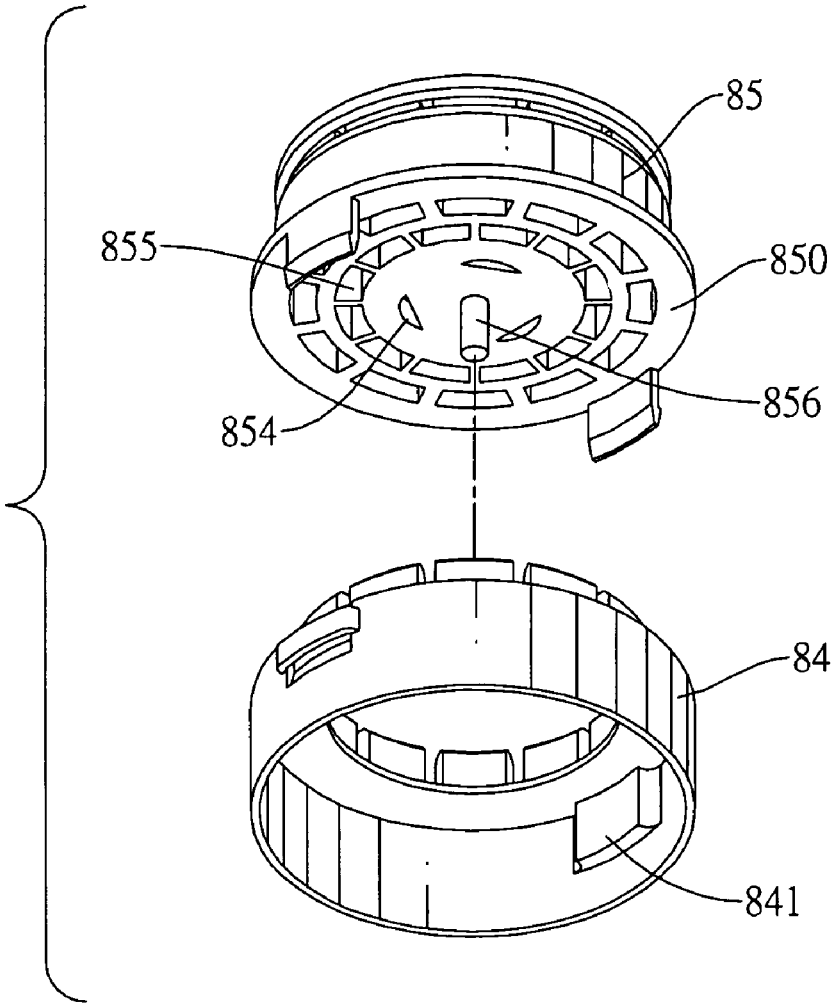
FIG.16 PRIOR ART
FIG. 16 is a partially enlarged exploded perspective view of the conventional sprinkler device in FIG. 14.
Figure 17:
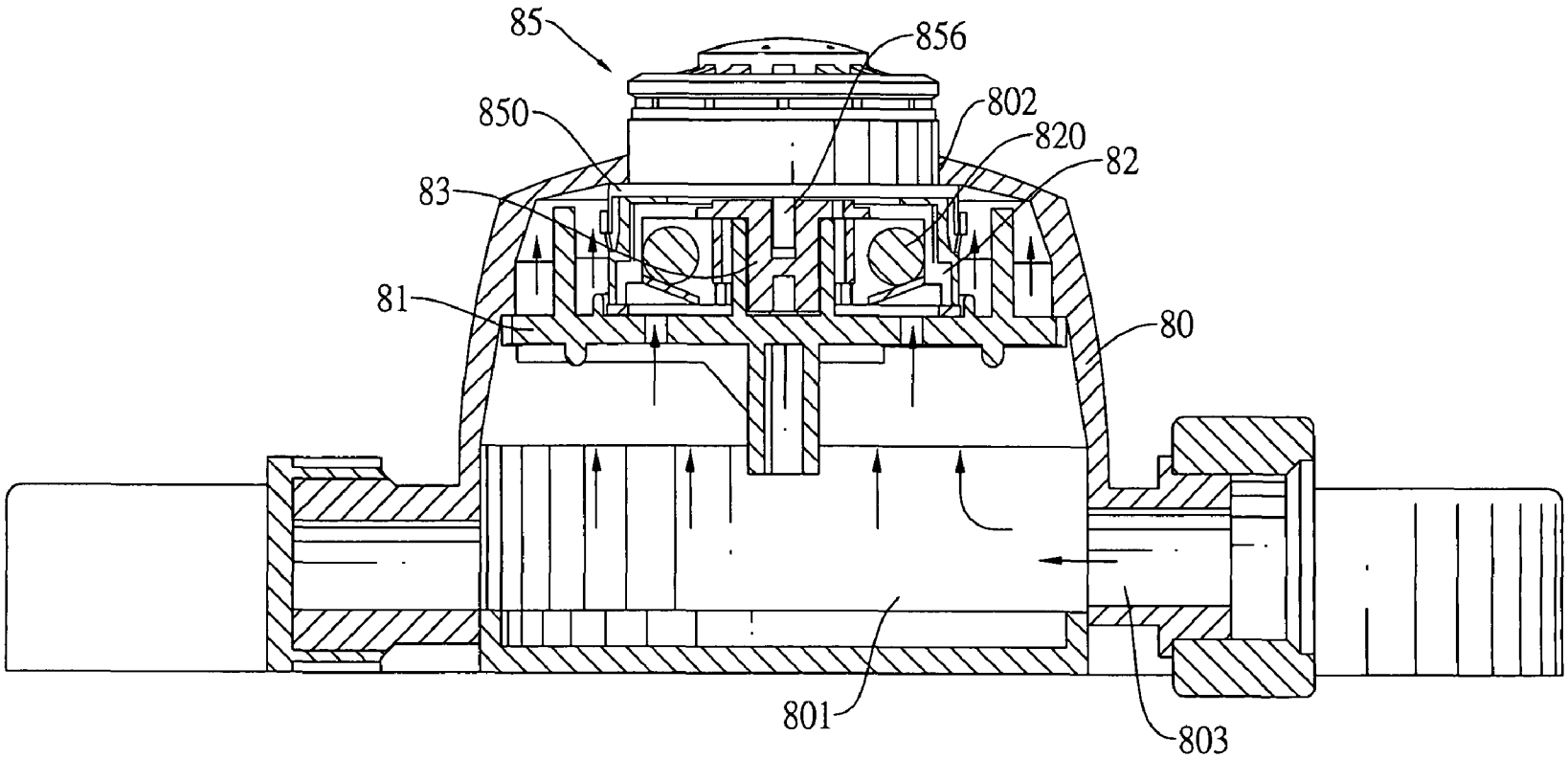
FIG.17 PRIOR ART
FIG. 17 is a cross-sectional side view of the conventional sprinkler device in FIG. 14.

With further reference to FIGS. 12 and 13, the spray nozzle assembly 70 has a top nozzle 71, a bottom nozzle 72 and a partition collar 73. The top nozzle 71 is hollow and has a curve ridge, a center post 710, multiple first spray holes 711 and multiple second spray holes 714. The curved ridge is formed across a top of the top nozzle 71. The center post 710 is formed at a center portion of the curved ridge. The first spray holes 711 are formed through a top of the center post 710 to communicate with an inner space of the center post 710. The second spray holes 714 are formed through the curved ridge and mutually spaced each other, and communicates with a space inside the top nozzle 71 and outside the center post 710.

The bottom nozzle 72 is hollow and has a top surface, a bottom surface, a top hole 721, a shaft rod 724, multiple cutouts 726, multiple positioning ribs 723, multiple alignment holes 722 and a block flange 725. The top hole 721 is centrally formed in the top surface of the bottom nozzle 72. The shaft rod 724 is centrally formed on and protrudes downwardly from the bottom surface, and is pivotally mounted in the shaft hole 63 of the outlet valve 60. The cutouts 726 are separately formed through a circumferential portion of the bottom surface of the bottom nozzle 72 around the shaft rod 724 and respectively communicate with the second spray holes 714. Each positioning rib 723 is formed between two corresponding cutouts 726 and is inserted in a corresponding positioning hole 23 of the rotary seat 20. The alignment holes 722 are formed through the bottom surface of the bottom nozzle 72. Each alignment hole 722 communicates with the bottom hole 712 of the top nozzle 71 and selectively aligns with a corresponding through hole 62 to communicate with or block the through hole 62 by a relative movement between the bottom surface of the bottom nozzle 72 and a top of the outlet valve 60. The block flange 725 is formed on and protrudes outwardly from a periphery of the bottom nozzle 72. The partition collar 73 is mounted between the top nozzle 71 and the bottom nozzle 72 and has a through hole 731 centrally formed through the partition collar 73 and communicating with the inner space of the center post 710 and the first spray holes 711.

The cover 50 has threads, a center hole 501, a first O-ring 52 and a second O-ring 51. The threads are formed on a periphery of the cover 50. The center hole 510 is centrally formed through the cover 50 and has an inner diameter smaller than an outer diameter of the block flange 725. The first O-ring 52 and the second O-ring 51 are sequentially mounted around the spray nozzle assembly 70 and are placed on the block flange 725. When the cover 50 are screwed into the body 13, an inner side of the cover 50 abuts against the first O-ring 52 and the second O-ring 51. When the spray nozzle assembly 70 is driven by the rotary seat 20 to rotate, the alignment holes 722 on the bottom surface of the spray nozzle assembly 70 selectively and respectively align and communicate with the through holes 62 of the outlet valve 60 so that water is sprayed out or not sprayed out from the first spray holes 711. Because water is filled between the space between the cover 50 and the body 13, pressurized water is also sprayed out through the second spray holes 714 through the space external to the center post 710 of the spray nozzle assembly 70. Besides the spray nozzle assembly 70 is smoothly rotated, water is also sprayed out through the first spray holes 711 and the second spray holes 714 with different spray patterns.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A sprinkler device comprising:

an inlet-driving assembly having:

a body being hollow and having:

a top;

a bottom;

a chamber defined inside the body;

an opening formed through the top of the body; and a water inlet formed through the bottom of the body;

a shaft seat mounted inside the chamber of the body and having:
a bottom;
a spindle centrally mounted on and protruding from the shaft seat; and
multiple water holes formed through the shaft seat, each water hole obliquely directed to the bottom of the shaft seat;
a spin element mounted around the spindle of the shaft seat and having:
a bottom being adjacent to the shaft seat;
a shaft hole centrally formed through the spin element and mounted around the spindle of the shaft seat;
multiple cutouts formed through the spin element and around the shaft hole;
two slots oppositely formed through the spin element;
two driving elements, each driving element received in a corresponding slot; and
multiple blades formed on the bottom of the spin element and respectively driven to rotate by water entered through the water holes of the shaft seat;
a rotary seat is an annular body in cross section, mounted outside the spin element, mounted around the spindle of the shaft seat and having:
a top;
an inner wall;
two push blocks formed on and protruding from the inner wall of the rotary seat, respectively corresponding to and selectively driven by the driving elements to move when respectively abutting against the driving elements; and
multiple through holes formed through the top of the rotary seat;
an outlet valve connected to the shaft seat and having:
a disk having
a top; and
a bottom;
a shaft column formed on and protruding downwardly from the bottom of the disk and mounted through the spindle of the shaft seat;
a shaft hole centrally formed in the top of the disk; and
multiple through holes circumferentially formed through the disk;
a spray nozzle assembly being hollow, connected to the outlet valve and having:
a first end;
a second end;
a periphery;
multiple first spray holes formed through the first end;
multiple second spray holes formed through the first end;
multiple alignment holes formed through the second end, respectively communicating with the first spray holes and selectively aligning with the through holes of outlet valve;
multiple cutouts formed through the second end and respectively communicating with the second spray holes;
a shaft rod formed on and protruding from the second end; and
a block flange formed on and protruding from the periphery of the spray nozzle assembly; and
a cover mounted on the spray nozzle assembly and having:
an inner space;
a center hole centrally formed through the cover, wherein the first end of the spray nozzle assembly protrudes beyond the center hole of the cover;
a first O-ring mounted on the block flange of the spray nozzle assembly; and
a second O-ring mounted on the first O-ring;
wherein the cover is mounted at the opening of the body, and the inner space of the cover and the shaft seat, the spin element, the rotary seat and outlet valve communicate with each other so that water entered from the water inlet is filled with the inner space of the cover.

2. The sprinkler device as claimed in claim 1, wherein the spray nozzle assembly further has:
a top nozzle having:
a center post being hollow and preventing the first spray holes from communicating with the second spray holes;
a bottom being cone-shaped; and
multiple narrow channels formed through the bottom of the top nozzle, each narrow channel having a top portion and a bottom portion, wherein each second spray hole is formed in the top portion of a corresponding narrow channel; and
a bottom nozzle having:
a top being hollowly cone-shaped and corresponding to and connected to the bottom of the top nozzle;
a bottom;
a periphery; and
a top hole formed in the top of the bottom nozzle and communicating with the alignment holes and the first spray holes of the top nozzle;
the first spray holes of the spray nozzle assembly are formed in the top nozzle;
the second spray hole of the spray nozzle assembly are formed in the top nozzle;
the block flange of the spray nozzle assembly is formed on and protrudes outwardly from the periphery of the bottom nozzle;
the shaft rod of the spray nozzle assembly is formed on and protrudes from the bottom of the bottom nozzle;
the alignment holes of the spray nozzle assembly are formed through the bottom of the bottom nozzle; and
the cutouts of the spray nozzle assembly are formed through the bottom of the bottom nozzle.

3. The sprinkler device as claimed in claim 2, wherein the first O-ring is made of polytetrafluoroethylene (PTFE), and the second O-ring is made of a waterproof material.

4. The sprinkler device as claimed in claim 3, wherein
the shaft rod of the bottom nozzle is pivotally mounted in the shaft hole of the outlet valve;
the bottom nozzle further has:
multiple positioning ribs, and each positioning rib formed between two corresponding cutouts of the bottom nozzle and around the shaft rod; and
the rotary seat further has:
multiple top bars radially formed on and protruding upwardly from the top of the rotary seat, wherein each through hole of the rotary seat is formed between two adjacent top bars; and
multiple locating holes, each locating hole formed through one of the top bars respectively aligning with the positioning ribs to receive a corresponding positioning rib.

5. The sprinkler device as claimed in claim 4, wherein
the spin element is an annular body in cross section, and has:
a board;
multiple annular walls formed around a perimeter of the board; and two guide pieces respectively formed inside the slots and extending obliquely and upwardly from the board of the spin element;

each driving element of the spin element is a metal ball; and the blades of the spin element are radially and separately formed on the bottom of the spin element and respectively correspond to the water holes of the shaft seat.

6. The sprinkler device as claimed in claim 5, wherein the spindle of the shaft seat has a positioning hole formed on and recessed from a top of the spindle, the shaft column of the outlet valve is mounted in the positioning hole, and each positioning hole and the shaft hole has a non-circular section.

7. The sprinkler device as claimed in claim 3, wherein the spin element is an annular body in cross section, and has:

a board;

multiple annular walls formed around a perimeter of the board; and two guide pieces respectively formed inside the slots and extending obliquely and upwardly from the board of the spin element;

each driving element of the spin element is a metal ball; and the blades of the spin element are radially and separately formed on the bottom of the spin element and respectively correspond to the water holes of the shaft seat.

8. The sprinkler device as claimed in claim 7, wherein the spindle of the shaft seat has a positioning hole formed on and recessed from a top of the spindle, the shaft column of the outlet valve is mounted in the positioning hole, and each positioning hole and the shaft hole has a non-circular section.

9. The sprinkler device as claimed in claim 1, wherein the spray nozzle assembly further has:

a top nozzle having:

a center post being hollow, having an inner space and preventing the first spray holes from communicating with the second spray holes;

a bottom being cone-shaped; and multiple narrow channels formed through the bottom of the top nozzle, each narrow channel having a top portion and a bottom portion, wherein each second spray hole is formed in the top portion of a corresponding narrow channel;

a bottom nozzle having:

a top being hollowly cone-shaped and corresponding to and connected to the bottom of the top nozzle;

a bottom;

a periphery; and a top hole formed in the top of the bottom nozzle and communicating with the alignment holes and the first spray holes of the top nozzle; and a partition collar mounted between the top nozzle and the bottom nozzle and having a through hole centrally formed through the partition collar and communicating with the inner space of the center post and the first spray holes;

the first spray holes of the spray nozzle assembly are formed in the top nozzle;

the second spray hole of the spray nozzle assembly are formed in the top nozzle;

the block flange of the spray nozzle assembly is formed on and protrudes outwardly from the periphery of the bottom nozzle;

the shaft rod of the spray nozzle assembly is formed on and protrudes from the bottom of the bottom nozzle;

the alignment holes of the spray nozzle assembly are formed through the bottom of the bottom nozzle; and the cutouts of the spray nozzle assembly are formed through the bottom of the bottom nozzle.

10. The sprinkler device as claimed in claim 9, wherein the first O-ring is made of a wear-resistant polytetrafluoroethylene (PTFE), and the second O-ring is made of a waterproof material.

11. The sprinkler device as claimed in claim 10, wherein the shaft rod of the bottom nozzle is pivotally mounted in the shaft hole of the outlet valve;

the bottom nozzle further has multiple positioning ribs, and each positioning rib is formed between two corresponding cutouts of the bottom nozzle and around the shaft rod; and the rotary seat further has:

multiple top bars radially formed on and protruding upwardly from the top of the rotary seat, wherein each through hole of the rotary seat is formed between two adjacent top bars; and multiple locating holes, each locating hole formed through one of the top bars respectively aligning with the positioning ribs to receive a corresponding positioning rib.

12. The sprinkler device as claimed in claim 11, wherein the spin element is an annular body in cross section, and has:

a board;

multiple annular walls formed around a perimeter of the board; and two guide pieces respectively formed inside the slots and extending obliquely and upwardly from the board of the spin element;

each driving element of the spin element is a metal ball; and the blades of the spin element are radially and separately formed on the bottom of the spin element and respectively correspond to the water holes of the shaft seat.

13. The sprinkler device as claimed in claim 12, wherein the spindle of the shaft seat has a positioning hole formed on and recessed from a top of the spindle, the shaft column of the outlet valve is mounted in the positioning hole, and each positioning hole and the shaft hole has a non-circular section.

14. The sprinkler device as claimed in claim 10, wherein the spin element is an annular body in cross section, and has:

a board;

multiple annular walls formed around a perimeter of the board; and two guide pieces respectively formed inside the slots and extending obliquely and upwardly from the board of the spin element;

each driving element of the spin element is a metal ball; and the blades of the spin element are radially and separately formed on the bottom of the spin element and respectively correspond to the water holes of the shaft seat.

15. The sprinkler device as claimed in claim 14, wherein the spindle of the shaft seat has a positioning hole formed on and recessed from a top of the spindle, the shaft column of the outlet valve is mounted in the positioning hole, and each positioning hole and the shaft hole has a non-circular section.

* * * * *